US009481981B2

(12) United States Patent
Magaki et al.

(10) Patent No.: US 9,481,981 B2
(45) Date of Patent: Nov. 1, 2016

(54) SHOVEL

(71) Applicant: SUMITOMO(S.H.I.) CONSTRUCTION MACHINERY CO., LTD., Tokyo (JP)

(72) Inventors: Hideto Magaki, Chiba (JP); Kiminori Sano, Chiba (JP); Ryota Kurosawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/191,560

(22) Filed: Feb. 27, 2014

(65) Prior Publication Data

US 2014/0297160 A1 Oct. 2, 2014

(30) Foreign Application Priority Data

Mar. 27, 2013 (JP) ..... 2013-067626

(51) Int. Cl.
*E02F 9/26* (2006.01)

(52) U.S. Cl.
CPC ..... *E02F 9/26* (2013.01)

(58) Field of Classification Search
CPC ..... G06F 17/00; G06F 11/3065; G06F 17/5009; G06F 9/06; G06F 15/00; G06F 17/5095; G06F 2217/16; G06F 9/44; G06F 19/167; G06F 19/0623; G06F 2041/224; G06F 2200/604; G06F 2250/21; F02D 28/00; F02D 29/00; F02D 31/007; F02D 41/2422; F02D 2200/604; F02D 41/083; F02D 19/0623; F02D 2041/224; F02D 2250/21; B61L 15/0081; B61L 3/006; B60W 40/09; B60W 50/08; B60W 10/06; B60W 2550/402; B60W 30/18; B60W 30/182; B60W 30/1882; B60W 10/22; G08G 1/096725; G08G 1/09675; G07C 5/00; G07C 5/0808; G07C 5/085; G07C 3/00; G07C 5/0816; Y02T 10/52; A01D 34/006; A01D 69/00; E02F 9/26

See application file for complete search history.

(56) References Cited

U.S. PATENT DOCUMENTS

| | | | | |
|---|---|---|---|---|
| 6,453,731 | B1 * | 9/2002 | Yaegashi | 73/114.52 |
| 7,483,814 | B2 * | 1/2009 | Hoshi et al. | 702/182 |
| 2005/0021245 | A1 * | 1/2005 | Furuno et al. | 702/33 |

(Continued)

FOREIGN PATENT DOCUMENTS

| | | |
|---|---|---|
| GB | 2405136 | 2/2005 |
| JP | 2005-098988 | 4/2005 |

(Continued)

*Primary Examiner* — Hung Q Nguyen
*Assistant Examiner* — Brian P Monahon
(74) *Attorney, Agent, or Firm* — IPUSA, PLLC

(57) ABSTRACT

A shovel includes a cabin in which a display monitor is provided, a main pump that generates a hydraulic pressure, an internal combustion engine that drives the main pump, and a display control part configured to generate display information to be displayed on the display monitor based on information communicated between the display control part and the internal combustion engine, and cause the generated display information to be displayed on the display monitor. The display control part is configured to cause a graph showing the fuel efficiency of the internal combustion engine over time and the operational work mode of the shovel corresponding to a time for which the fuel efficiency is calculated to be simultaneously displayed on the single display screen of the display monitor.

12 Claims, 8 Drawing Sheets

(56) References Cited

U.S. PATENT DOCUMENTS

| | | | | |
|---|---|---|---|---|
| 2006/0212203 | A1* | 9/2006 | Furuno | 701/50 |
| 2007/0171087 | A1* | 7/2007 | Shimazu | B60K 37/02 340/679 |
| 2009/0299707 | A1* | 12/2009 | Putkonen | 703/2 |
| 2011/0210838 | A1* | 9/2011 | Fujiki et al. | 340/439 |
| 2011/0276261 | A1* | 11/2011 | Mizutani | 701/123 |
| 2012/0185159 | A1* | 7/2012 | Yamauchi et al. | 701/123 |
| 2012/0197465 | A1* | 8/2012 | Gotou et al. | 701/2 |
| 2012/0323453 | A1* | 12/2012 | Havimaki et al. | 701/50 |
| 2013/0057305 | A1* | 3/2013 | Jimbo | B60L 11/005 324/750.01 |

FOREIGN PATENT DOCUMENTS

| | | |
|---|---|---|
| JP | 2008-062791 | 3/2008 |
| JP | 2010-023738 | 2/2010 |
| KR | 2002-0076268 | 10/2002 |

* cited by examiner

200

300

400

500

SHOVEL

CROSS-REFERENCE TO RELATED APPLICATION

This application is based upon and claims the benefit of priority of Japanese Patent Application No. 2013-067626, filed on Mar. 27, 2013, the entire contents of which are incorporated herein by reference.

BACKGROUND

1. Technical Field

The present invention relates to shovels including a display unit that displays an operating condition.

2. Description of Related Art

Shovels commonly have a display monitor provided in their cabins. By looking at a screen on the display monitor, it is possible for an operator of a shovel to check the operating condition of the shovel at the time. For example, a construction machine has been proposed that includes a display part configured to perform such display as to make it possible to determine a difference between measured engine fuel efficiency and set engine fuel efficiency.

SUMMARY

According to an aspect of the present invention, a shovel includes a cabin in which a display monitor is provided, a main pump that generates a hydraulic pressure, an internal combustion engine that drives the main pump, and a display control part configured to generate display information to be displayed on the display monitor based on information communicated between the display control part and the internal combustion engine, and cause the generated display information to be displayed on the display monitor. The display control part is configured to cause a graph showing the fuel efficiency of the internal combustion engine over time and the operational work mode of the shovel corresponding to a time for which the fuel efficiency is calculated to be simultaneously displayed on the single display screen of the display monitor.

It is to be understood that both the foregoing general description and the following detailed description are exemplary and explanatory and not restrictive of the invention.

DETAILED DESCRIPTION

According to related art shovels, a display unit displays a single content per screen. In order to cause such a display unit to display multiple contents, it is required to switch the screen of the display unit. Therefore, the operator is required to release her/his hand from an operation lever when the operator desires to switch the screen to display other content. During shovel work, however, it is impossible for the operator to release her/his hand from the operation lever. Therefore, it is impossible to switch the screen and thus to view desired content during shovel work.

During shovel work, the operator monitors the basic condition of the shovel displayed on a basic screen and is prevented from viewing a screen that displays information on engine fuel efficiency, for example. Accordingly, it is impossible to provide the operator with information (content) regarding the fuel efficiency of the shovel while the operator is operating the shovel. Therefore, the operator is prevented from operating the shovel while considering engine fuel efficiency.

According to an aspect of the present invention, a shovel is provided that is capable of providing an operator with information on the fuel efficiency of an engine without requiring the operator to operate a display unit during shovel work.

According to an aspect of the present invention, it is possible to encourage an operator at work to operate a lever efficiently so as to improve the fuel efficiency of an internal combustion engine by causing the fuel efficiency to be displayed simultaneously in multiple graphs having different time axes on a single screen.

A description is given below, with reference to the accompanying drawings, of embodiments of the present invention.

Figure 1:
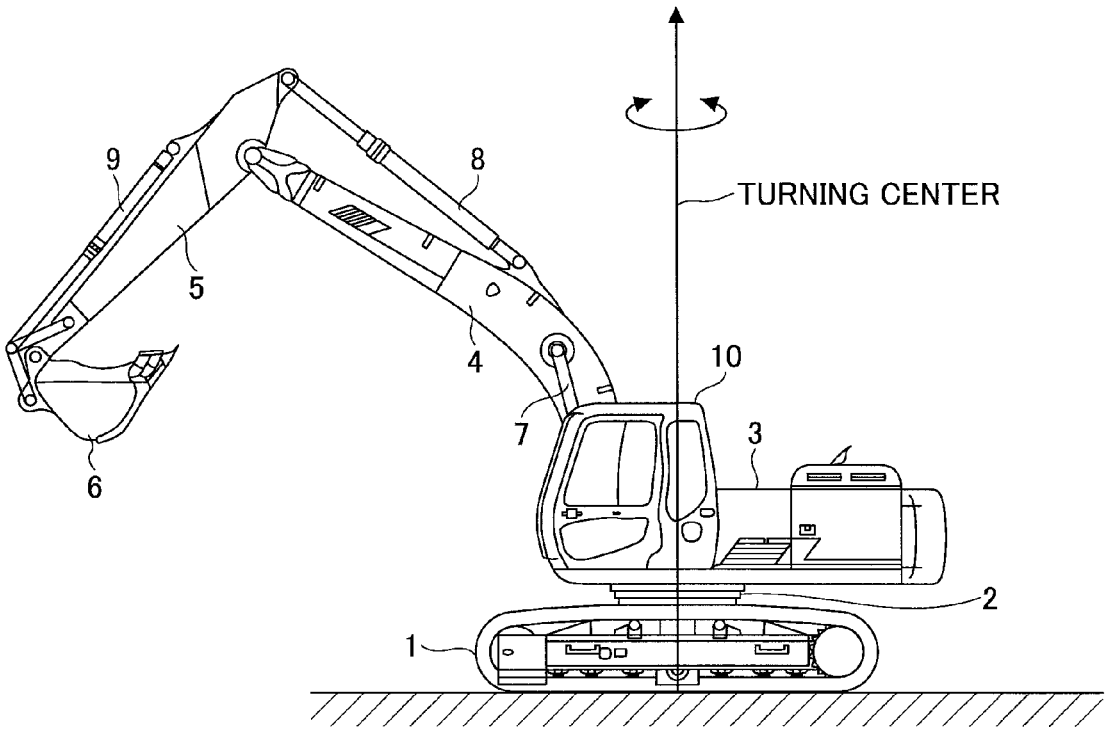
FIG. 1 is a side view of a shovel according to an embodiment.

FIG. 1 is a side view of a shovel according to an embodiment. The shovel illustrated in FIG. 1 is a hybrid shovel. Embodiments of the present invention, however, may be applied to not only hybrid shovels but also any kinds of shovels as long as the shovels include an electrical energy storage device as a power supply for driving an electrical load.

Referring to FIG. 1, an upper-part turning body 3 (an upper-part turnable body) is mounted through a turning mechanism 2 on a lower-part traveling body 1 (a lower-part movable body) of the shovel. A boom 4, an arm 5, a bucket 6, and a boom cylinder 7, an arm cylinder 8, and a bucket cylinder 9 for hydraulically driving the boom 4, the arm 5, and the bucket 6, respectively, are provided on the upper-part turning body 3. Furthermore, a cabin 10 and power sources are mounted on the upper-part turning body 3.

Figure 2:
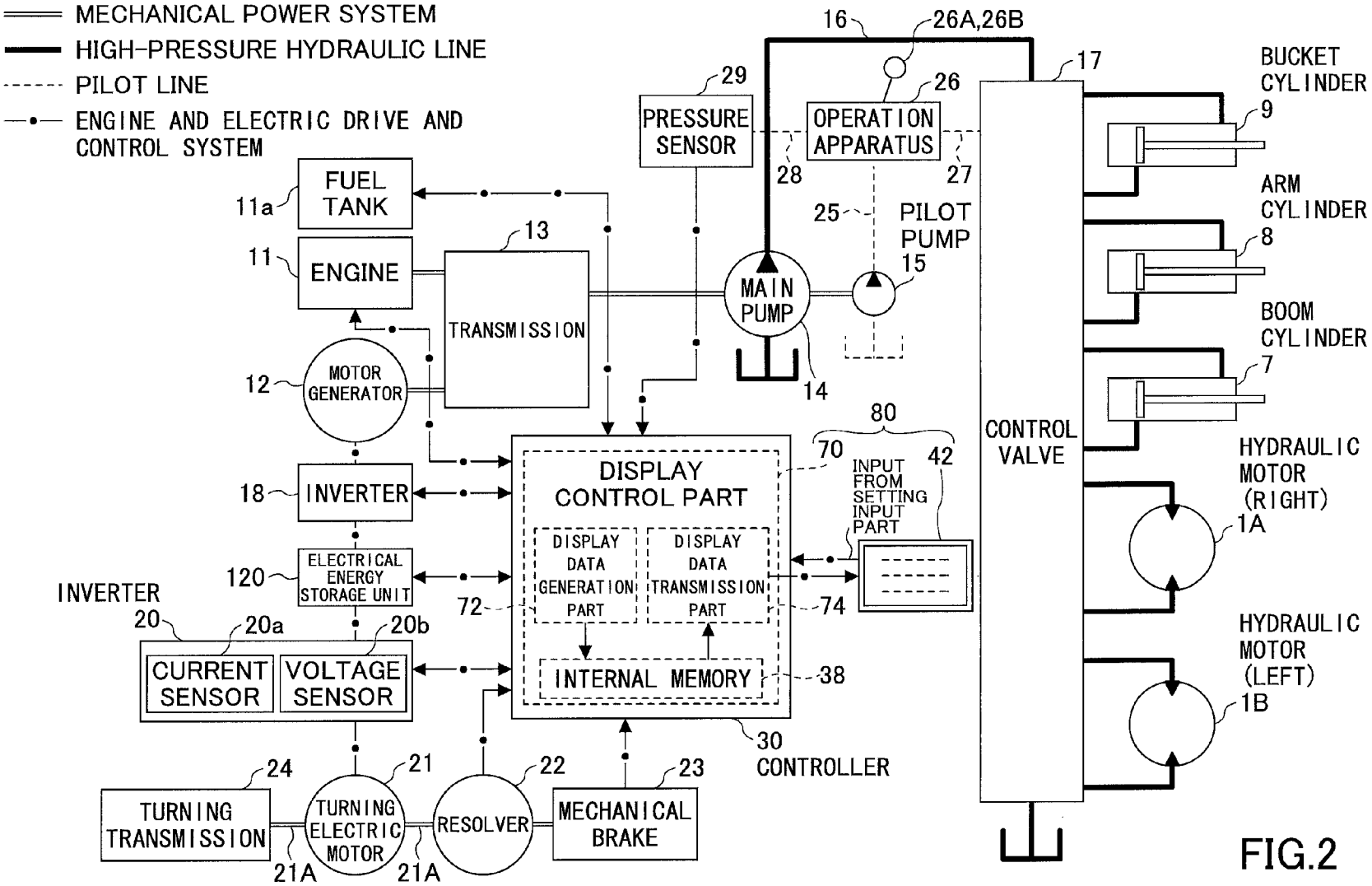
FIG. 2 is a block diagram illustrating a configuration of a drive system of the shovel illustrated in FIG. 1 according to an embodiment.

FIG. 2 is a block diagram illustrating a configuration of a drive system of the shovel illustrated in FIG. 1 according to an embodiment. In FIG. 2, a mechanical power system, a high-pressure hydraulic line, a pilot line, and an engine and electric drive and control system are indicated by a double line, a solid line, a broken line, and a dot-dash line, respectively.

An engine 11 as a mechanical drive part and a motor generator 12 as an assist drive part are connected to a first input shaft and a second input shaft, respectively, of a transmission 13. A main pump 14 and a pilot pump 15 are connected to the output shaft of the transmission 13. A control valve 17 is connected to the main pump 14 via a high-pressure hydraulic line 16.

The control valve 17 is a control unit that controls a hydraulic system of the shovel. Hydraulic motors 1A (right) and 1B (left) for the lower-part traveling body 1, the boom cylinder 7, the arm cylinder 8, and the bucket cylinder 9 are connected to the control valve 17 via high-pressure hydraulic lines.

An electrical energy storage unit 120 including an electrical energy storage device, which is a capacitor or a battery for storing electrical energy, is connected to the motor generator 12 via an inverter 18. According to this embodiment, it is assumed that the electrical energy storage unit 120 includes a capacitor such as an electric double-layer capacitor (EDLC) as the electrical energy storage device. Furthermore, a turning electric motor 21 is connected to the electrical energy storage unit 120 via an inverter 20. A capacitor is illustrated above as an example of the electrical energy storage device. Alternatively, in place of the capacitor, a rechargeable battery, which is chargeable and dischargeable, such as a lithium ion battery (LIB), or other form of power supply capable of transferring and receiving electric power may be used as the electrical energy storage device.

A resolver 22, a mechanical brake 23, and a turning transmission 24 are connected to a rotating shaft 21A of the turning electric motor 21. Furthermore, an operation apparatus 26 is connected to the pilot pump 15 via a pilot line 25.

The control valve 17 and a pressure sensor 29 as a lever operation detecting part are connected to the operation apparatus 26 via hydraulic lines 27 and 28, respectively. A controller 30 that controls the driving of an electric system is connected to the pressure sensor 29.

As described above, the inverter 18 is provided between the motor generator 12 and the electrical energy storage unit 120. The inverter 18 controls the operation of the motor generator 12 based on commands from the controller 30. This makes it possible for the inverter 18 to supply electric power from the electrical energy storage unit 120 to the motor generator 12 when the motor generator 12 performs a power running operation, and to store the electric power generated by the motor generator 12 in the electrical energy storage device of the electrical energy storage unit 120 when the motor generator 12 performs a regenerative operation.

The electrical energy storage unit 120 is provided between the inverter 18 and the inverter 20. This makes it possible for the electrical energy storage unit 120 to supply electric power for a power running operation when at least one of the motor generator 12 and the turning electric motor 21 performs a power running operation, and to store the electric power regenerated by a regenerative operation as electrical energy when at least one of the motor generator 12 and the turning electric motor 21 performs a regenerative operation.

As described above, the inverter 20 is provided between the turning electric motor 21 and the electrical energy storage unit 120. The inverter 20 controls the operation of the turning electric motor 21 based on commands from the controller 30. This makes it possible for the inverter 20 to supply electric power from the electrical energy storage unit 120 to the turning electric motor 21 when the turning electric motor 21 performs a power running operation, and to store the electric power generated by the turning electric motor 21 in the electrical energy storage device of the electrical energy storage unit 120 when the turning electric motor 21 performs a regenerative operation.

The charge and discharge of the electrical energy storage device of the electrical energy storage unit 120 is controlled by the controller 30 based on the state of charge of the electrical energy storage device, the operating state (power running operation or regenerative operation) of the motor generator 12, and the operating state (power running operation or regenerative operation) of the turning electric motor 21.

Furthermore, the inverter 20 includes a current sensor 20*a* and a voltage sensor 21*a*.

The controller 30 is a control unit serving as a main control part that controls the driving of the hybrid shovel. The controller 30 includes a processor including a central processing unit (CPU) and an internal memory 38 (FIG. 2). The controller 30 is a device implemented by the CPU executing a drive control program contained in the internal memory 38.

The controller 30 converts a signal fed from the pressure sensor 29 into a speed command, and controls the driving of the turning electric motor 21. The signal fed from the pressure sensor 29 corresponds to a signal that represents the amount of operation in the case of operating the operation apparatus 26 in order to cause the turning mechanism 2 to turn.

The controller 30 controls the operation (switches the electric motor [assist] operation and the generator operation) of the motor generator 12, and controls the charge and discharge of the electrical energy storage device by controlling the driving of a step-up/step-down converter 100 (FIG. 3) of the electrical energy storage unit 120. The controller 30 controls the charge and discharge of the electrical energy storage device by controlling the switching of the step-up operation and the step-down operation of the step-up/step-down converter 100 of the electrical energy storage unit 120 based on the state of charge of the electrical energy storage device, the operating state (electric motor [assist] operation or generator operation) of the motor generator 12, and the operating state (power running operation or regenerative operation) of the turning electric motor 21. Furthermore, the controller 30 also controls the amount of charging the electrical energy storage device (charging current or charging electric power) as described below.

The controller 30 transmits or receives the water temperature of the cooling water of the engine 11, a command value of the amount of fuel injection of the engine 11, and the usage condition of an exhaust gas filter (DPF regenerator) through a communication circuit provided between the controller 30 and the engine 11. Furthermore, the controller 30 receives the level of remaining fuel measured with a fuel gauge provided in a fuel tank 11*a* through a communication circuit provided between the controller 30 and the fuel tank 11*a*. Furthermore, the controller 30 receives information on the condition of settings of the shovel input from a setting input part (a display monitor 42) described below by an operator, through a communication circuit provided between the controller 30 and the setting input part.

Figure 3:
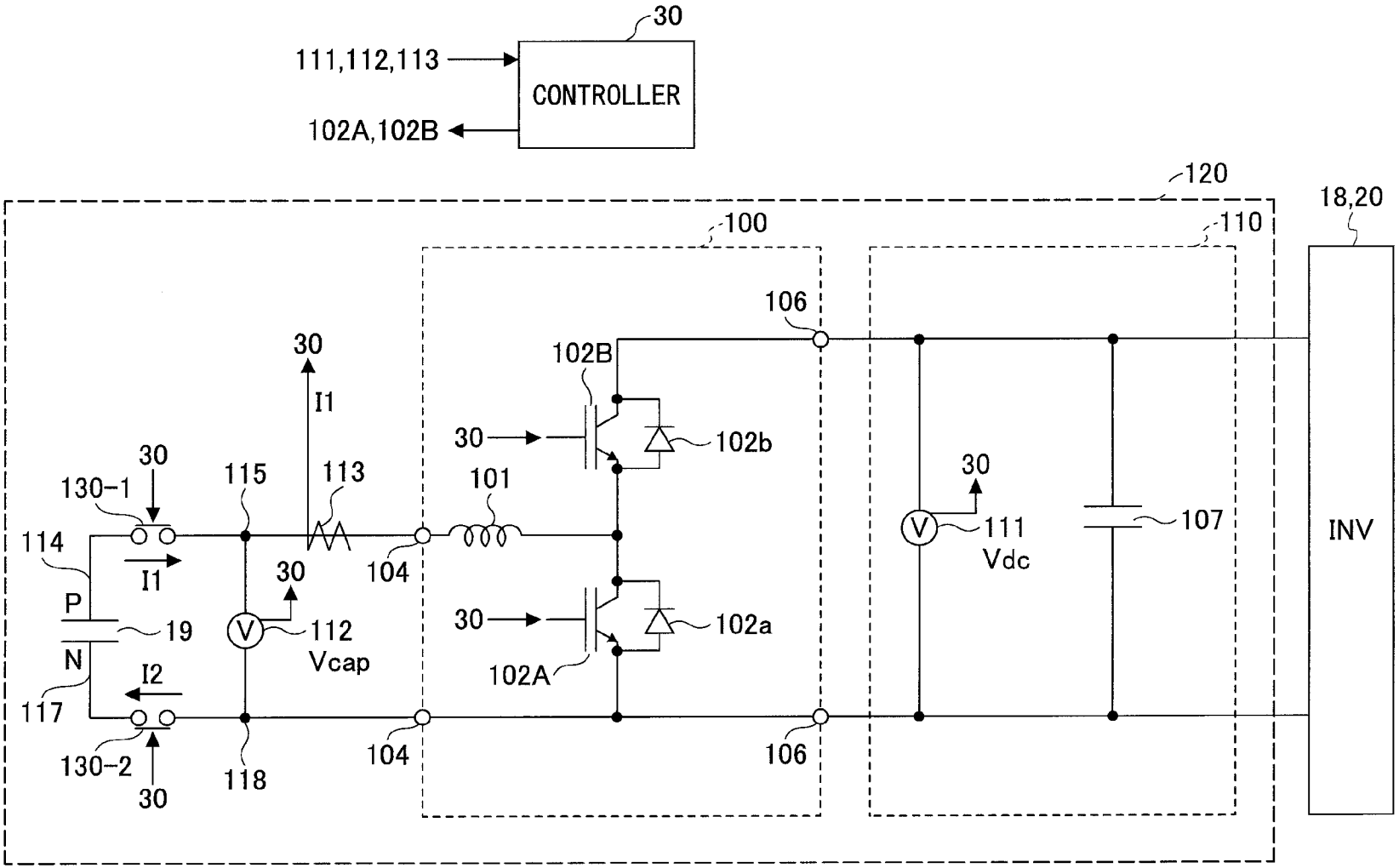
FIG. 3 is a circuit diagram of an electrical energy storage unit according to an embodiment.

FIG. 3 is a circuit diagram of the electrical energy storage unit 120 according to an embodiment. The electrical energy storage unit 120 includes a capacitor 19 as an electrical energy storage device, the step-up/step-down converter 100, and a DC bus 110. The DC bus 110 controls the transfer of electric power among the capacitor 19, the motor generator 12, and the turning electric motor 21. The capacitor 19 is provided with a capacitor voltage detecting part 112 for detecting a capacitor voltage value and a capacitor current detecting part 113 for detecting a capacitor current value. The capacitor voltage value detected by the capacitor voltage detecting part 112 and the capacitor current value detected by the capacitor current detecting part 113 are fed to the controller 30.

The step-up/step-down converter 100 performs such control as the switching of a step-up operation and a step-down operation in accordance with the operating states of the motor generator 12 and the turning electric motor 21, so that the DC bus voltage value falls within a certain range. The DC bus 110 is provided between the inverters 18 and 20 and the step-up/step-down converter 100 to transfer electric power among the capacitor 19, the motor generator 12, and the turning electric motor 21.

The switching of the step-up operation and the step-down operation of the step-up/step-down converter 100 is controlled based on the DC bus voltage value detected by a DC bus voltage detecting part 111, the capacitor voltage value detected by the capacitor voltage detecting part 112, and the capacitor current value detected by the capacitor current detecting part 113.

In the configuration as described above, the electric power generated by the motor generator 12, which is an assist motor, is supplied to the DC bus 110 of the electrical energy storage unit 120 via the inverter 18 to be supplied to the capacitor 19 via the step-up/step-down converter 100. The electric power regenerated by the regenerative operation of the turning electric motor 21 is supplied to the DC bus 110 of the electrical energy storage unit 120 via the inverter 20 to be supplied to the capacitor 19 via the step-up/step-down converter 100. The step-up/step-down converter 100 includes a reactor 101, a step-up IGBT (Insulated Gate Bipolar Transistor) 102A, a step-down IGBT 102B, power supply connection terminals 104 for connecting the capacitor 19, and output terminals 106 for connecting the inverters 18 and 20. The output terminals 106 of the step-up/step-down converter 100 and the inverters 18 and 20 are connected by the DC bus 110.

The reactor 101 has one end connected to a point between the step-up IGBT 102A and the step-down IGBT 102B and has the other end connected to one of the power supply connection terminals 104. The reactor 101 is provided to supply the DC bus 110 with the induced electromotive power generated with the turning-on/off of the step-up IGBT 102A.

The step-up IGBT 102A and the step-down IGBT 102B, which are constituted of bipolar transistors each having a MOSFET (Metal Oxide Semiconductor Field Effect Transistor) incorporated into its gate part, are semiconductor devices (switching elements) capable of high-speed switching with high power. The step-up IGBT 102A and the step-down IGBT 102B are driven by application of PWM voltage to their gate terminals by the controller 30. Diodes 102*a* and 102*b*, which are rectifying elements, are connected in parallel to the step-up IGBT 102A and the step-down IGBT 102B, respectively.

The capacitor 19 may be a chargeable and dischargeable electrical energy storage device so as to enable transfer of electric power to and from the DC bus 110 via the step-up/step-down converter 100. In FIG. 3, the capacitor 19 is illustrated as an electrical energy storage device. Alternatively, in place of the capacitor 19, a rechargeable battery, which is chargeable and dischargeable, such as a lithium ion battery, or other form of power supply capable of transferring and receiving electric power may be used.

The power supply connection terminals 104 may be terminals to which the capacitor 19 may be connected, and the output terminals 106 may be terminals to which the inverters 18 and 20 may be connected. The capacitor voltage detecting part 112 that detects the capacitor voltage is connected between the paired power supply connection terminals 104. The DC bus voltage detecting part 111 that detects the DC bus voltage is connected between the paired output terminals 106.

The capacitor voltage detecting part 112 detects the voltage value Vcap of the capacitor 19. The DC bus voltage detecting part 111 detects the voltage value Vdc of the DC bus 110. A smoothing capacitor 107 is an electrical energy storage element inserted between the positive and the negative output terminal 106 to smooth the DC bus voltage. The voltage of the DC bus 110 is maintained at a predetermined voltage by this smoothing capacitor 107.

The capacitor current detecting part 113 is a detecting part that detects the value of an electric current flowing through the capacitor 19 on the positive terminal (P terminal) side of the capacitor 19. That is, the capacitor current detecting part 113 detects the value of an electric current I1 that flows through the positive terminal of the capacitor 19.

In the step-up/step-down converter 100, at the time of raising the voltage of the DC bus 110, a PWM voltage is applied to the gate terminal of the step-up IGBT 102A, so that the induced electromotive force generated in the reactor 101 with the turning-on/off of the step-up IGBT 102A is supplied to the DC bus 110 via the diode 102*b* connected in parallel to the step-down IGBT 102B. As a result, the voltage of the DC bus 110 is raised.

At the time of lowering the voltage of the DC bus 110, a PWM voltage is applied to the gate terminal of the step-down IGBT 102B, so that regenerated electric power supplied via the inverter 18 or 20 is supplied from the DC bus 110 to the capacitor 19 via the step-down IGBT 102B. As a result, the capacitor 19 is charged with the electric power stored in the DC bus 110, so that the voltage of the DC bus 110 is lowered.

According to this embodiment, in a power supply line 114 that connects the positive terminal of the capacitor 19 to the one of the power supply connection terminals 104 of the step-up/step-down converter 100, a relay 130-1 is provided as a breaker capable of breaking the power supply line 114. The relay 130-1 is placed between a connecting point 115, where the capacitor voltage detecting part 112 is connected to the power supply line 114, and the positive terminal of the capacitor 19. The relay 130-1 is caused to operate by a signal from the controller 30, and is capable of disconnecting the capacitor 19 from the step-up/step-down converter 100 by breaking the power supply line 114 from the capacitor 19.

Furthermore, in a power supply line 117 that connects the negative terminal of the capacitor 19 to the other of the power supply connection terminals 104 of the step-up/step-down converter 100, a relay 130-2 is provided as a breaker capable of breaking the power supply line 117. The relay 130-2 is placed between a connecting point 118, where the capacitor voltage detecting part 112 is connected to the power supply line 117, and the negative terminal of the capacitor 19. The relay 130-2 is caused to operate by a signal from the controller 30, and is capable of disconnecting the capacitor 19 from the step-up/step-down converter 100 by breaking the power supply line 117 from the capacitor 19. The capacitor 19 may be disconnected by breaking both the power supply line 114 on the positive terminal side and the power supply line 117 on the negative terminal side simultaneously, forming the relay 130-1 and the relay 130-2 as a single relay.

In practice, there is a drive part that generates PWM signals to drive the step-up IGBT 102A and the step-down IGBT 102B between the controller 30 and the step-up IGBT 102A and the step-down IGBT 102B. In FIG. 3, however, the drive part is omitted. Such a drive part may be implemented by either an electronic circuit or a processor.

Figure 4:
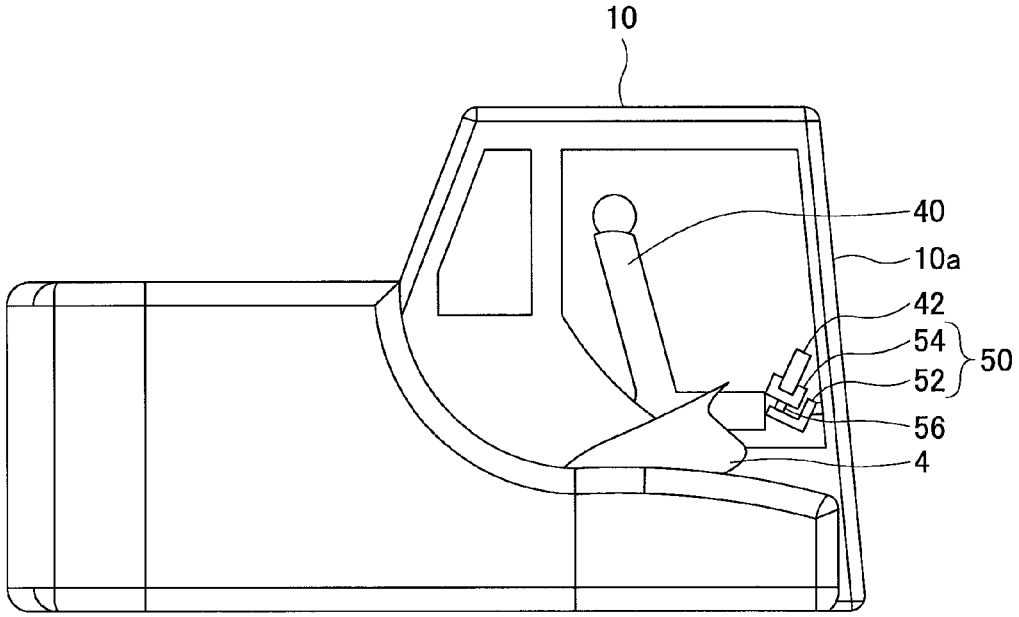
FIG. 4 is a perspective view of a cabin, illustrating its interior, according to an embodiment.
Figure 5:
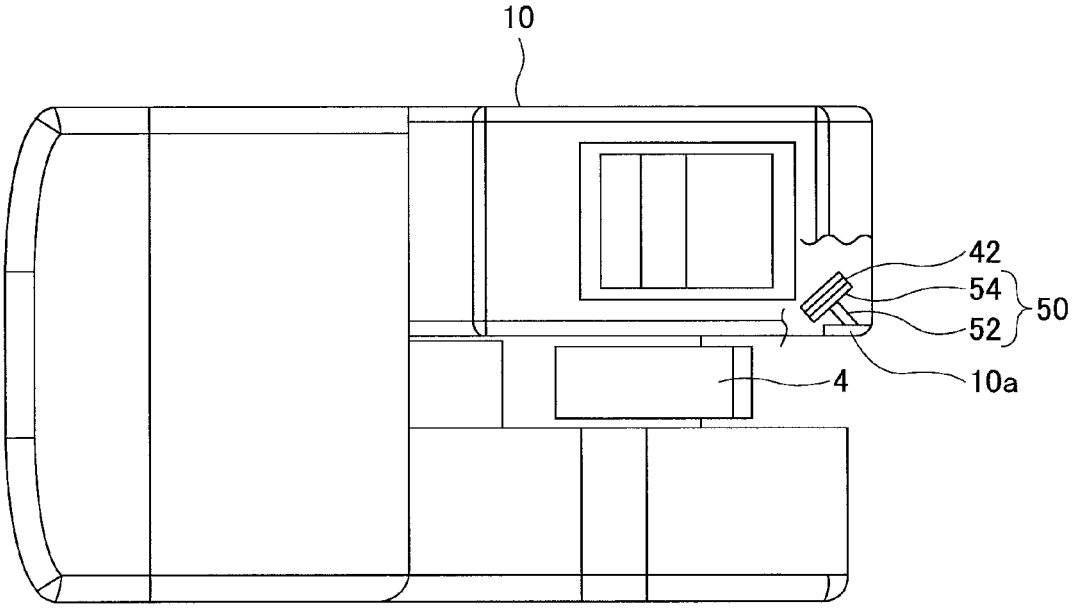
FIG. 5 is a plan view of the cabin in which a display monitor is provided according to an embodiment.

FIG. 4 is a side view of the cabin 10, illustrating its interior, according to an embodiment. FIG. 5 is a plan view of the cabin 10, in which a display monitor is provided, according to an embodiment.

An operator's seat 40 is provided inside the cabin 10, and the display monitor 42 is placed near the operator's seat 40. It is possible for an operator seated on the operator's seat 40 to understand the state of each part of the shovel by viewing the display monitor 42 while operating operation levers 26A and 26B (FIG. 2). As described below, various kinds of information (contents) are displayed on the display monitor 42 by a display control part 70 (FIG. 1).

An attachment part 50 for attaching the display monitor 42 includes an installation base 52 and a mount part 54 supported by the installation base 52. The installation base 52 is attached and fixed to a frame 10*a* of the cabin 10, in which the operator's seat 40 is provided. The mount part 54 is supported on the installation base 52 through a damping mechanism 56, which includes an elastic body such as a spring or rubber, so as to prevent direct transmission of vibrations of or impact on the cabin 10 to the mount part 54 via the installation base 52. That is, the mount part 54 is supported on the installation base 52 through the damping mechanism 56, so that vibrations of or impact on the cabin 10 transmitted to the display monitor 42 fixed to the mount part 54 is reduced.

In general, the boom 4 is disposed on the right side as viewed from the operator seated on the operator's seat 40, and the operator often operates the shovel while viewing the arm 5 attached to the end of the boom 4 or the bucket 6 attached to the arm 5. The frame 10*a*, which is on the front right side of the cabin 10, is a part that obstructs the operator's view. According to this embodiment, the attachment part 50 of the display monitor 42 is provided using this part. Thus, because the display monitor 42 is placed on the part that is an obstruction to the view from the beginning, the display monitor 42 does not itself obstruct the operator's view. Depending on the width of the frame 10*a*, it is preferable to determine the size of the display monitor 42 so that the entire display monitor 42 fits in the width of the frame 10*a*.

According to this embodiment, a display unit such as an LCD touchscreen panel is employed as the display monitor 42. Alternatively, a portable terminal (a multifunction portable information terminal) may be used as a display unit.

Next, a description is given of a display unit according to an embodiment. Referring to FIG. 2, a display unit 80 according to an embodiment includes the display control part 70 included in the controller 30 and the display monitor 42 provided inside the cabin 10. The display control part 70 is a functional element that is implemented by the CPU of the controller 30 executing a display control program contained in the internal memory 38.

As illustrated in FIG. 2, the display control part 70 of the controller 30 includes a display data generation part 72 and a display data transmission part 74.

The display data generation part 72 creates display data that are displayed on the display monitor 42 based on detection values from various sensors (detectors) transmitted to the controller 30 and stored information (data). The detection values and the stored information include the above-described water temperature of the cooling water of the engine 11, command value of the amount of fuel injection of the engine 11, and usage condition of an exhaust gas filter (DPF regenerator) that the controller 30 transmits or receives through the communication circuit provided between the controller 30 and the engine 11. The display data generation part 72 stores created display data in the internal memory 38 of the controller 30. The display data transmission part 74 reads display data stored in the internal memory 38 and suitably transmits the read display data to the display monitor 42.

In response to reception of the display data, the display monitor 42 displays a screen based on the display data. It is possible for the operator to obtain various kinds of information including the condition of the shovel by viewing the screen of the display monitor 42.

According to this embodiment, the display monitor 42 also operates as a setting input part. As described above, an LCD touchscreen panel or the like is employed as the display monitor 42, and info/oration regarding the condition of settings (setting condition) of the shovel, such as a work mode, may be input from the display monitor 42 by the operator.

According to this embodiment, the display monitor 42 also operates as a setting input part. Alternatively, for example, in the case of not using a touchscreen panel as the display monitor 42, a setting input part may be provided separately from the display monitor 42. Furthermore, a touchscreen panel that also operates as a setting input part and a setting input part provided separately from the touchscreen panel may be combined, so that different setting input parts may be used depending on the contents of settings.

Figure 6:
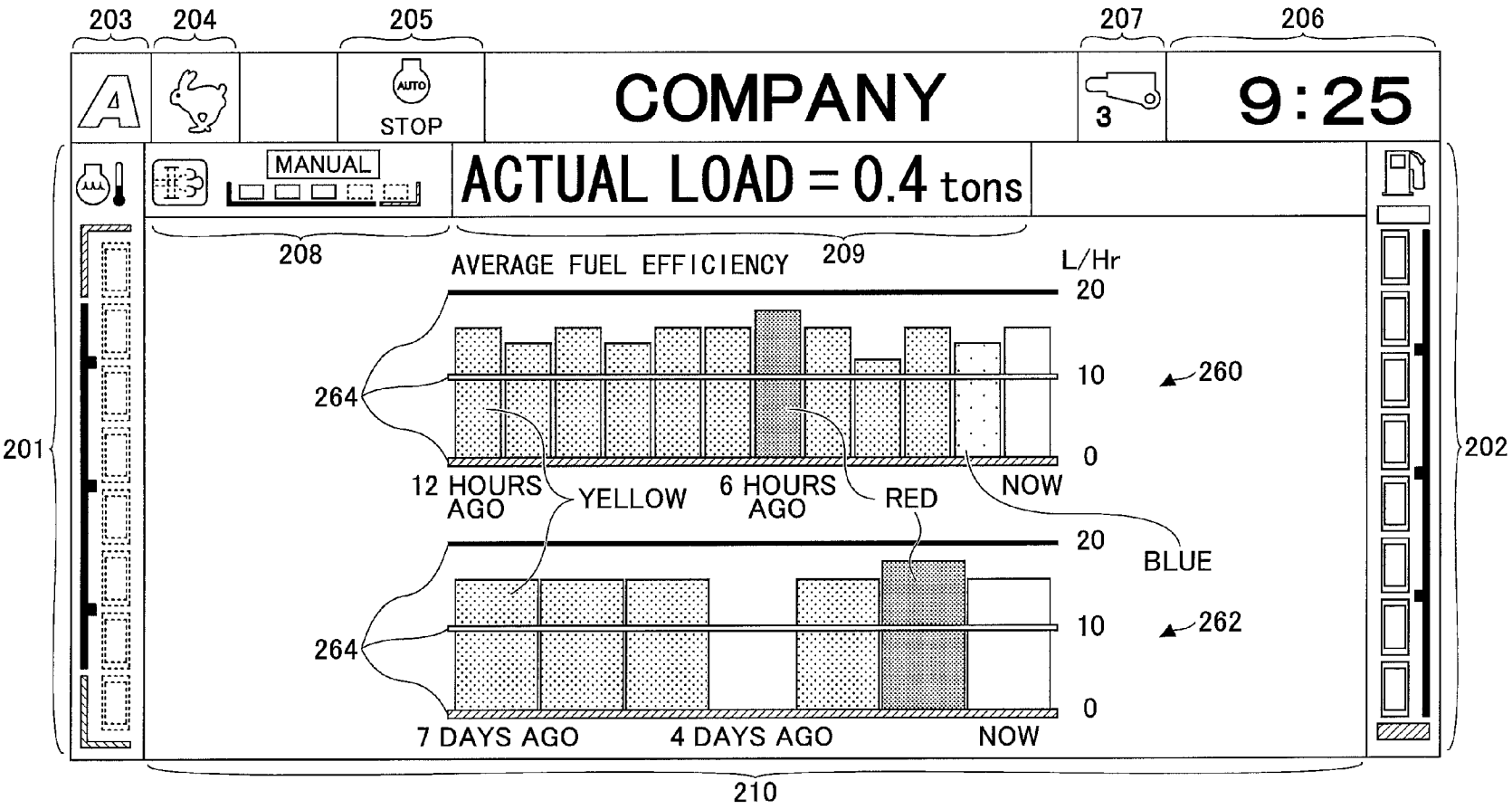
FIG. 6 is a diagram illustrating a screen of the display monitor on which multiple graphs showing average fuel efficiency, to which information on a work mode is added, are displayed according to an embodiment.

Next, a description is given of information (content) that a display unit displays on the display monitor 42 according to an embodiment. FIG. 6 is a diagram illustrating a screen of the display monitor 42 on which multiple graphs showing average fuel efficiency are displayed.

On a rectangular display screen 200 illustrated in FIG. 6, the water temperature of the engine 11 is displayed on a multilevel scale in a region 201 along the left side. Furthermore, the remaining amount of fuel stored in the fuel tank 11*a* is displayed on a multilevel scale in a region 202 along the right side. The engine water temperature and the remaining amount of fuel, which are information items to be constantly observed by the operator, correspond to information on the operating condition of the shovel.

The water temperature of the engine 11 displayed in the region 201 is information obtained from the engine 11 via the above-described communication circuit by the controller 30. Furthermore, the remaining amount of fuel displayed in the region 202 is information obtained from the fuel gauge of the fuel tank 11*a* via the above-described communication circuit by the controller 30.

A work mode that is currently set for the shovel is displayed in a region 203 at the left end of a region along the upper side of the display screen 200. The work mode is input from the setting input part (the display monitor 42) by the operator. The work mode is a mode for limiting the output of the shovel. For example, one of an automatic mode "A," a heavy mode "H," and a superpower mode "SP" is set as the work mode. The automatic mode "A" is a power save mode, in which the shovel is operated in such a manner as to reduce engine fuel consumption. The heavy mode "H" is a mode to increase engine output to make it possible to do heavy work. The superpower mode "SP" is a mode for temporarily exerting a large work force by further increasing engine output from that of the heavy mode "H." In the case illustrated in FIG. 6, "A" is displayed, so that it is possible for the operator to recognize that the power save mode is set.

In a region 204 on the right side next to the region 203, where the work mode is indicated, a traveling mode is displayed as the setting mode of traveling hydraulic motors using a variable displacement pump. The traveling mode includes a low-speed mode and a high-speed mode. The low-speed mode is displayed using a mark (schematic diagram) in the shape of a "tortoise" and the high-speed mode is displayed with a mark (schematic diagram) in the shape of a "rabbit." In the case illustrated in FIG. 6, the mark (schematic diagram) in the shape of a "rabbit" is displayed, so that it is possible for the operator to recognize that the high-speed mode is set.

In a region 205 on the right side next to the region 204, where the traveling mode is displayed, the stopped/operating state of the engine 11 is displayed. In the case illustrated in FIG. 6, "STOP" is displayed to indicate that the engine 11 is stopped.

In a region 206 at the right end of the region along the upper side of the display screen 200, the current time is displayed. In the case illustrated in FIG. 6, it is indicated that the current time is 9:25.

In a region 207 on the left side next to the time display region 206, a currently attached attachment is displayed. Attachments attachable to the shovel include various attachments such as a bucket, a rock drill, a grapple, and a lifting magnet. In the region 207, marks (schematic diagrams) in the shape of these attachments and numbers corresponding to the attachments are displayed. In the case illustrated in FIG. 6, a mark (schematic diagram) in the shape of a rock drill is displayed, and "3" is displayed as a number indicating the magnitude of the output of the rock drill.

Other information may be displayed in a region between the region 205 and the region 207. For example, the name of a manufacturer of the shovel may be displayed as other information. Furthermore, the information displayed in the above-described regions 203, 204, 205, and 207 is information input from the setting input part (display monitor 42) and obtained by the controller 30 via the above-described communication circuit.

In a region 208 under the region 204 and the region 205, the operating time of an exhaust gas filter is displayed. Furthermore, in an upper part of the region 208, a setting as to whether to remove captured matter automatically or manually is displayed.

The operating time of an exhaust gas filter and so on displayed in the region 208 are information items obtained from the engine 11 via the above-described communication circuit by the controller 30.

In a region 209 on the right side next to the region 208, a load applied to the end of the arm 5 is numerically displayed. In the case illustrated in FIG. 6, "ACTUAL LOAD=0.4 tons" is displayed in the region 209, so that it is possible to know that the load applied to the end of the arm 5 is 0.4 tons.

The load applied to the end of the arm 5 displayed in the region 209 is information obtained from a hydraulic sensor (not illustrated) by the controller 30.

The above-described information displayed in the regions 201 through 209 indicates the operating condition and the setting condition of the shovel. That is, the information displayed in the regions 201, 202, 208, and 209 is information on the operating condition of the shovel, and the information displayed in the regions 203, 204, 205, and 207 is information on the setting condition of the shovel. The information on the operating condition and the setting condition of the shovel is standard information displayed on the display screen 200.

According to this embodiment, additional information other than the above-described display information is displayed in a region 210. According to this embodiment, as illustrated in FIG. 6, multiple graphs (two graphs in this embodiment) that show the average fuel efficiency of the engine 11 are displayed in the region 210. The two graphs are displayed one above the other on the screen. An upper graph is a bar graph 260 that shows the hour-by-hour average fuel efficiency of the past 12 hours. A lower graph is a bar graph 262 that shows the day-by-day average fuel efficiency of the past 7 days. That is, the upper graph and the lower graph, which are both graphs that show average fuel efficiency, have different time axes, so that the upper graph has a time axis of an interval of the past 12 hours and shows the hour-by-hour average fuel efficiency, while the lower graph has a time axis of an interval of the past 7 days and shows the day-by-day average fuel efficiency.

The average fuel efficiency is determined based on a command value of the amount of fuel injection transmitted from the controller 30 to the engine 11.

In the case illustrated in FIG. 6, in the bar graph 260 showing the average fuel efficiency of the past 12 hours, the hour-by-hour average fuel efficiency is represented by vertical bars (extending toward the upper side of the screen) on the screen. Accordingly, 12 bars representing the average fuel efficiency are displayed in the bar graph 260 that shows the average fuel efficiency of the past 12 hours. Of the bars, a bar that represents the average fuel efficiency of the last 1 hour is displayed differently from the other bars. Specifically, the luminance of the bar representing the average fuel efficiency of the last 1 hour is caused to be higher than the luminance of the other bars, or the bar representing the average fuel efficiency of the last 1 hour is displayed in a color different from the color of the other bars. This facilitates visual recognition of the average fuel efficiency of the last 1 hour.

Beside the bar representing the average fuel efficiency of the last 1 hour, numbers that represent fuel efficiency are displayed. In the case illustrated in FIG. 6, predetermined numbers of "0," "10" and "20" are displayed, so that, for example, when a bar representing the average fuel efficiency starts at "0" and extends up to a level just halfway between "10" and "20," it is possible to easily visually recognize that the average fuel efficiency indicated by the bar is 15 (L/Hr). Linear indicators 264 extending in the width directions of the 12 bars (horizontally on the screen) are displayed in correspondence to the positions at which the predetermined numbers ("0," "10" and "20") representing values of the average fuel efficiency are displayed. The linear indicator 264 indicating the position of the value "10" (L/Hr) of the average fuel efficiency extends across the 12 bars, thus facilitating visual recognition of the average fuel efficiency of bars that are distant from the displayed numerical values.

Furthermore, "NOW" is displayed below the bar representing the average fuel efficiency of the last 1 hour, thus making it easy to visually recognize that the bar is the average fuel efficiency of the last 1 hour (that is, a current average fuel efficiency). Likewise, "6 HOURS AGO" is displayed below a bar that represents the average fuel efficiency between 5 hours ago and 6 hours ago, and "12 HOURS AGO" is displayed below a bar that represents the average fuel efficiency between 11 hours ago and 12 hours ago.

Furthermore, in the case illustrated in FIG. 6, in the bar graph 262 that shows the average fuel efficiency of the past 7 days, displayed below the bar graph 260 showing the average fuel efficiency of the past 12 hours, the day-by-day average fuel efficiency is represented by vertical bars (extending toward the upper side of the screen) on the screen. Accordingly, seven bars representing the average fuel efficiency are displayed in the bar graph 262 that shows the average fuel efficiency of the past 7 days. Of the bars, a bar that represents the average fuel efficiency of the last 1 day is displayed differently from the other bars. Specifically, the luminance of the bar representing the average fuel efficiency of the last 1 day is caused to be higher than the luminance of the other bars, or the bar representing the average fuel efficiency of the last 1 day is displayed in a color different from the color of the other bars. This facilitates visual recognition of the average fuel efficiency of the last 1 day.

Beside the bar representing the average fuel efficiency of the last 1 day, numbers that represent fuel efficiency are displayed. The display of numerical values and the display of linear indicators are the same as those in the bar graph 260 showing the average fuel efficiency of the past 12 hours described above.

Furthermore, "NOW" is displayed below the bar representing the daily average fuel efficiency between now and 1 day ago, thus making it easy to visually recognize that the bar is the average fuel efficiency of the last 1 day (that is, a current average fuel efficiency). Likewise, "4 DAYS AGO" is displayed below a bar that represents the daily average fuel efficiency between 3 days ago and 4 days ago, and "7 DAYS AGO" is displayed below a bar that represents the daily average fuel efficiency between 6 days ago and 7 days ago.

In the example display illustrated in FIG. 6, no bar is displayed in a part for showing the average fuel efficiency of "4 DAYS AGO." This indicates that the shovel was not in operation "4 DAYS AGO." For example, no bar is thus displayed that represents the average fuel efficiency in the case where it was a Sunday "4 DAYS AGO" and there was no shovel work because of a holiday.

According to this embodiment, in addition to the above-described display of average fuel efficiency, information on the work mode of the shovel is displayed. That is, work modes that are set in time periods corresponding to the above-described bars representing average fuel efficiency are displayed in the graphs of average fuel efficiency.

The operational work mode (also simply referred to as "work mode") of the shovel includes multiple work modes. According to this embodiment, one of the superpower mode (SP mode), the heavy mode (H mode), and the automatic mode (A mode) may be set as the operational work mode of the shovel. The shovel operator selects a work mode to be used and sets the work mode via the operation part of the shovel.

The SP mode is a work mode for performing work by setting the output of the engine 11 to a higher level so as to make it possible to temporarily accommodate a large load. When the SP mode is set, the rotational speed of the engine 11 is set to be higher than usual, for example, to 1800 rpm. Furthermore, the output of the main pump 14 also is set to be higher.

The H mode is a work mode that is set when performing normal work. When the H mode is set, the rotational speed of the engine 11 is set to a value lower than the rotational speed at the time of the SP mode, for example, 1700 rpm.

The A mode, which is also called "eco mode," is a work mode to reduce energy consumption (the amount of fuel consumed by the engine 11) by reducing output compared with the H mode that is usually set. When the A mode is set, the rotational speed of the engine 11 is set to a value lower than the rotational speed at the time of the H mode, for example, 1600 rpm.

When performing shovel work, the operator determines which work mode to use based on the contents of work and sets the determined work mode. In the case of normal work, the operator selects and sets the H mode. In the case of work that is heavier than usual and requires high power, the operator selects and sets the SP mode. If it is desired to perform work with a reduced amount of fuel consumption, the operator selects and sets the A mode.

On the display screen 200 illustrated in FIG. 6, display is performed so as to facilitate visually recognizing a work mode corresponding to a time for which the average fuel efficiency is shown, that is, which work mode is set in a time for which the average fuel efficiency is shown. That is, the work modes are assigned respective predetermined colors, and the bars of graphical display showing the average fuel efficiency are colored with the colors assigned to the work modes. As a result, by looking at the color of a bar of the graph showing the average fuel efficiency, it is possible to easily understand what work mode was set in a time (for example, 6 hours ago or 3 days ago) corresponding to the bar.

To be more specific, according to this embodiment, of the work modes, the SP mode is assigned red, the H mode is assigned yellow, and the A mode is assigned blue. For example, it is assumed that in FIG. 6, the work mode set in a time corresponding to the bar of the average fuel efficiency of 6 hours ago is the SP mode. In this case, the bar of the average fuel efficiency of 6 hours ago is displayed in red assigned to the SP mode. Likewise, it is assumed that the work mode set in a time corresponding to the bar of the average fuel efficiency of 1 day ago is the SP mode. In this case, the bar of the average fuel efficiency of 1 day ago is displayed in red assigned to the SP mode.

On the other hand, for example, if the work mode set in a time corresponding to the bar of the average fuel efficiency of 2 hours ago is the A mode in FIG. 6, the bar of the average fuel efficiency of 2 hours ago is displayed in blue assigned to the A mode. In the case illustrated in FIG. 6, no bar is displayed in blue in the graph showing the fuel efficiency averaged on a daily basis (the lower graph). Thus, the A mode has been set in no time.

When the unit time for averaging (an hour and a day in the case illustrated in FIG. 6) increases, the set work mode may be switched to another mode within the unit time. In this case, the bar display of average fuel efficiency is performed by selecting a color assigned to a dominant work mode in the unit time. The term "dominant" means that the work mode is set for a longer time than other work modes.

For example, it is assumed that in the unit time (1 hour [60 minutes]) of 6 hours ago, the SP mode was set for 45 minutes and the H mode was set for the remaining 15 minutes. In this case, the SP mode was set for a longer time than the H mode.

Therefore, in this case, the SP mode is regarded as a dominant work mode, and the bar showing the average fuel efficiency of 6 hours ago is displayed in red assigned to the SP mode.

When the unit time increases, all of the SP mode, the H mode, and the A mode may be set within the unit time. In this case as well, a work mode set for the longest time is regarded as a dominant work mode, and the bar is displayed in a color assigned to the work mode.

Thus, coloring the bars of a graph showing average fuel efficiency and indicating work modes set at the times remind the operator of, for example, a work mode at the time of good average fuel efficiency, thus triggering a review of a currently set work mode by the operator. That is, by displaying information on the work mode in a graph showing average fuel efficiency, it is possible to encourage the operator to set a work mode that improves fuel efficiency.

Furthermore, in the example display illustrated in FIG. 6, the bar graph 260 that shows the average fuel efficiency of the past 12 hours and the bar graph 262 that shows the average fuel efficiency of the past 7 days are simultaneously displayed on a single screen. Therefore, it is possible for the shovel operator to go back to 12 hours ago to 7 days ago to determine whether the fuel efficiency in current work due to her/his lever operation is better or worse than the fuel efficiency in the past work. Then, for example, if the current work is similar to the work of 5 days ago, the operator may compare the fuel efficiency of 5 days ago and current fuel efficiency and control the lever operation in the current work so that the lever operation in the current work comes closer to a lever operation in the work of 5 days ago. For example, if the fuel efficiency in the current work is worse than the fuel efficiency of 5 days ago, it is possible for the operator to improve the fuel efficiency in the current work by recalling and approximating the lever operation of 5 days ago.

In the example display illustrated in FIG. 6, two graphs of average fuel efficiency having different time axes are displayed. Alternatively, if the display area permits, three or more graphs having different time axes may be displayed. That is, this specification discloses simultaneous display of multiple graphs of average fuel efficiency having different time axes on a single display screen.

Figure 7:
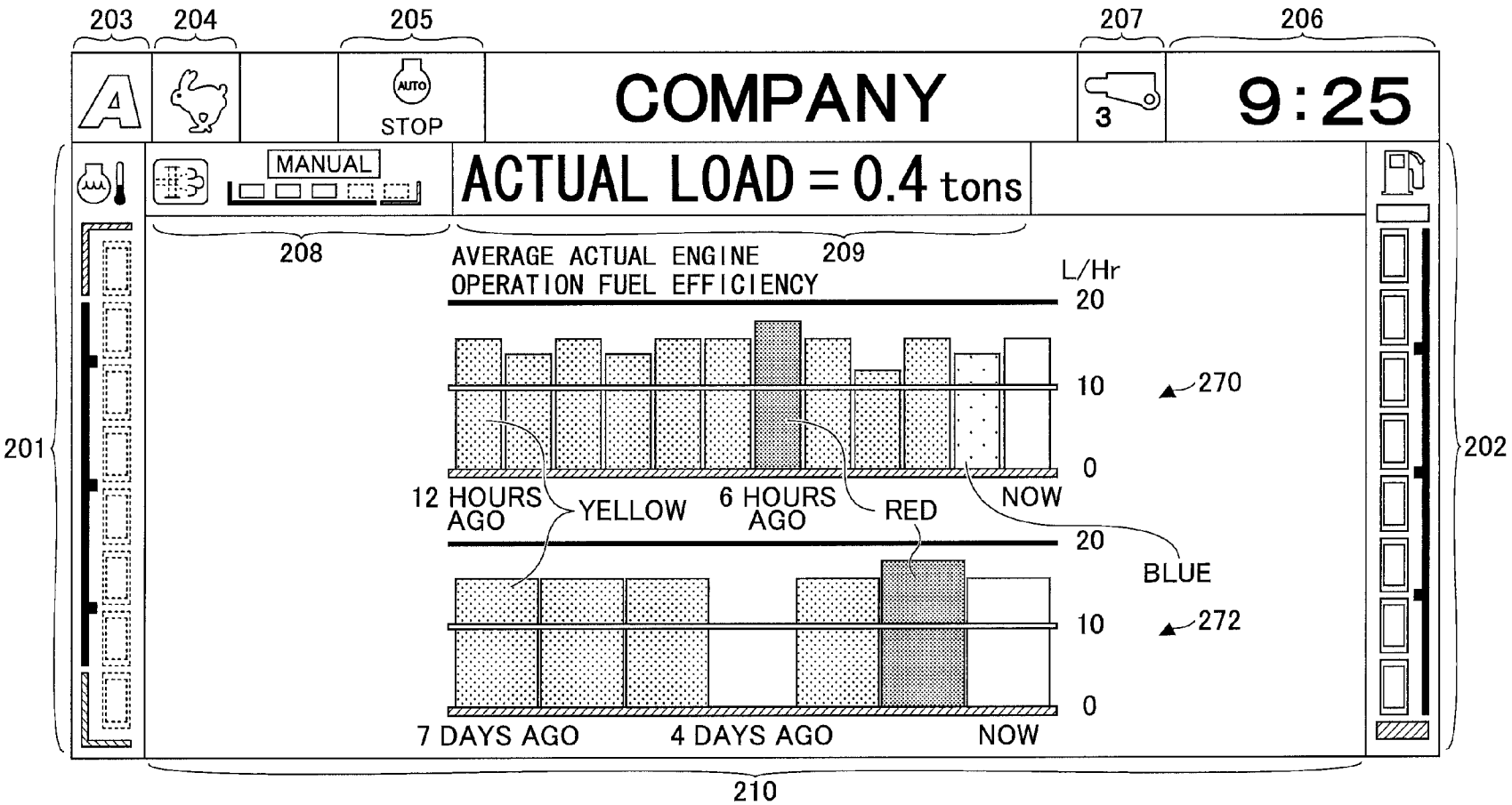
FIG. 7 is a diagram illustrating a screen of the display monitor on which multiple graphs showing average actual engine operation fuel efficiency, to which information on a work mode is added, are displayed according to an embodiment.

In FIG. 6, the average fuel efficiency is graphically displayed. Alternatively, in place of the average fuel efficiency, average actual engine operation fuel efficiency may be graphically displayed. FIG. 7 is a diagram illustrating a screen of the display monitor 42 on which two graphs of average actual engine operation fuel efficiency having different time axes are displayed in the same manner as in the case illustrated in FIG. 6. That is, on a display screen 300 illustrated in FIG. 7, the bar graphs 260 and 262 of average fuel efficiency illustrated in FIG. 6 are replaced with bar graphs 270 and 272, respectively, of average actual engine operation fuel efficiency, but the contents of display are otherwise the same as those illustrated in FIG. 6.

Like in the case illustrated in FIG. 6, in the graphs of the average actual engine operation fuel efficiency illustrated in FIG. 7 as well, information on the work mode is added to the bars showing the average actual engine operation fuel efficiency. That is, the bars showing the average actual engine operation fuel efficiency are displayed in colors assigned to work modes that are dominant in the respective times.

The average actual engine operation fuel efficiency is the fuel efficiency of the engine 11 averaged based solely on time during which the shovel is in operation, that is, the engine 11 of the shovel is in operation. According to the average fuel efficiency illustrated in FIG. 6, the fuel efficiency is averaged by time including time during which the shovel is not in operation, that is, the engine 11 is stopped, so that the average fuel efficiency varies in response to variations in the time during which the engine 11 is stopped. Accordingly, in the case illustrated in FIG. 7, the average actual engine operation fuel efficiency, which is the fuel efficiency of the engine 11 of the shovel averaged based solely on the time during which the engine 11 is in operation, is graphically displayed. As a result, such variations in the average fuel efficiency are removed, so that more accurate average fuel efficiency is displayed.

Figure 8:
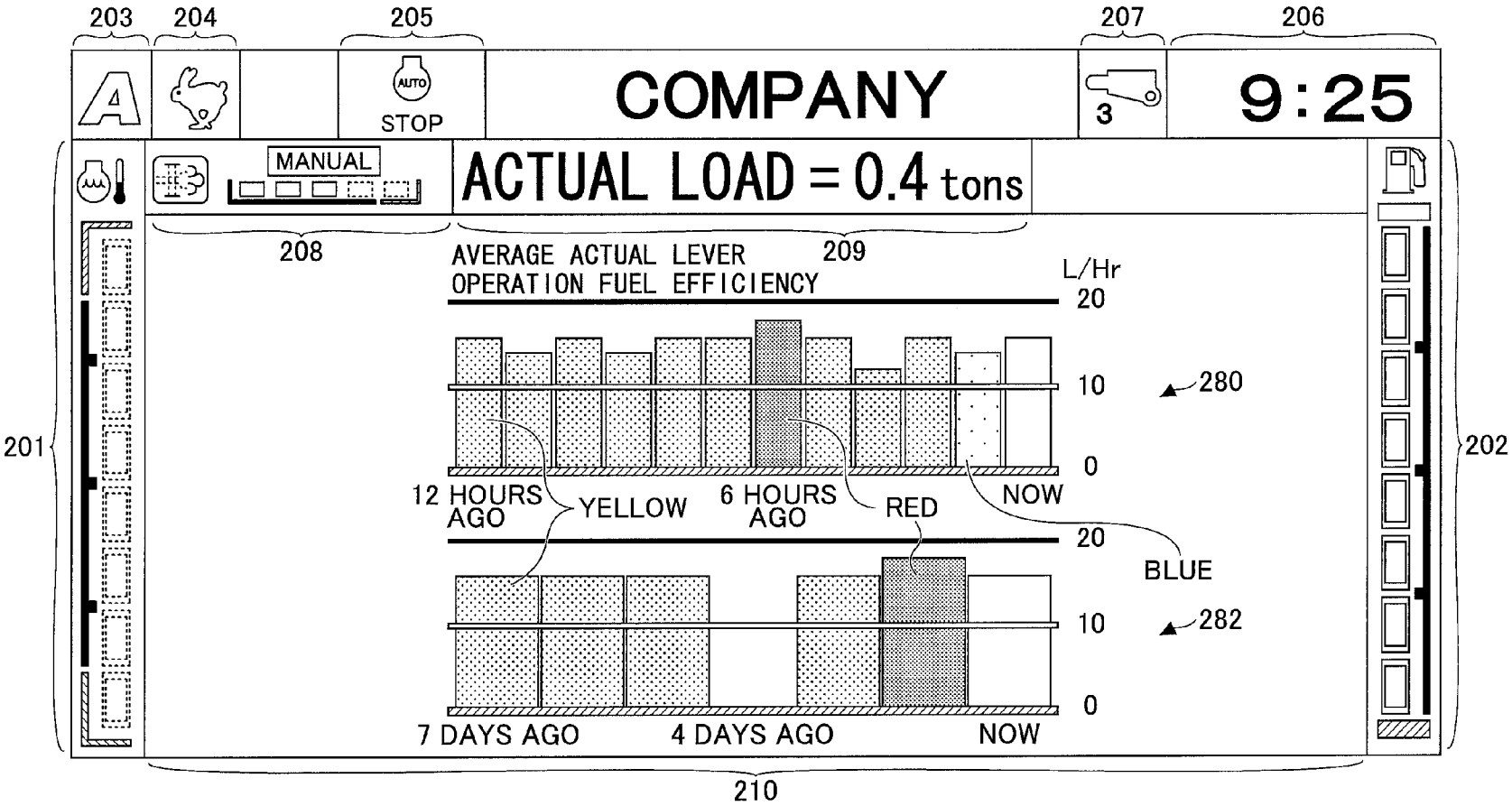
FIG. 8 is a diagram illustrating a screen of the display monitor on which multiple graphs showing average actual lever operation fuel efficiency, to which information on a work mode is added, are displayed according to an embodiment.

Furthermore, in place of the average fuel efficiency illustrated in FIG. 6, average actual lever operation fuel efficiency may alternatively be displayed. FIG. 8 is a diagram illustrating a screen of the display monitor 42 on which two graphs of average actual lever operation fuel efficiency having different time axes are displayed in the same manner as in the case illustrated in FIG. 6. That is, on a display screen 400 illustrated in FIG. 8, the bar graphs 260 and 262 of average fuel efficiency illustrated in FIG. 6 are replaced with bar graphs 280 and 282, respectively, of average actual lever operation fuel efficiency, but the contents of display are otherwise the same as those illustrated in FIG. 6.

Like in the case illustrated in FIG. 6, in the graphs of the average actual lever operation fuel efficiency illustrated in FIG. 8 as well, information on the work mode is added to the bars showing the average actual lever operation fuel efficiency. That is, the bars showing the average actual lever operation fuel efficiency are displayed in colors assigned to work modes that are dominant in the respective times.

The average actual lever operation fuel efficiency is the fuel efficiency of the engine 11 averaged based solely on time during which the shovel is working, that is, the operator is operating a lever (for example, the operation lever 26A or 26B in FIG. 2). According to the average actual engine operation fuel efficiency illustrated in FIG. 7, the fuel efficiency is averaged by time including time during which the engine 11 is running idle with no work performed, so that the average fuel efficiency varies in response to variations in the time during which the engine 11 is running idle. Accordingly, in the case illustrated in FIG. 8, the average actual lever operation fuel efficiency, which is the fuel efficiency of the engine 11 of the shovel averaged based solely on the time during which a lever of the shovel is being operated, is graphically displayed. As a result, such variations in the average actual engine operation fuel efficiency are removed, so that more accurate average fuel efficiency is displayed.

Figure 9:
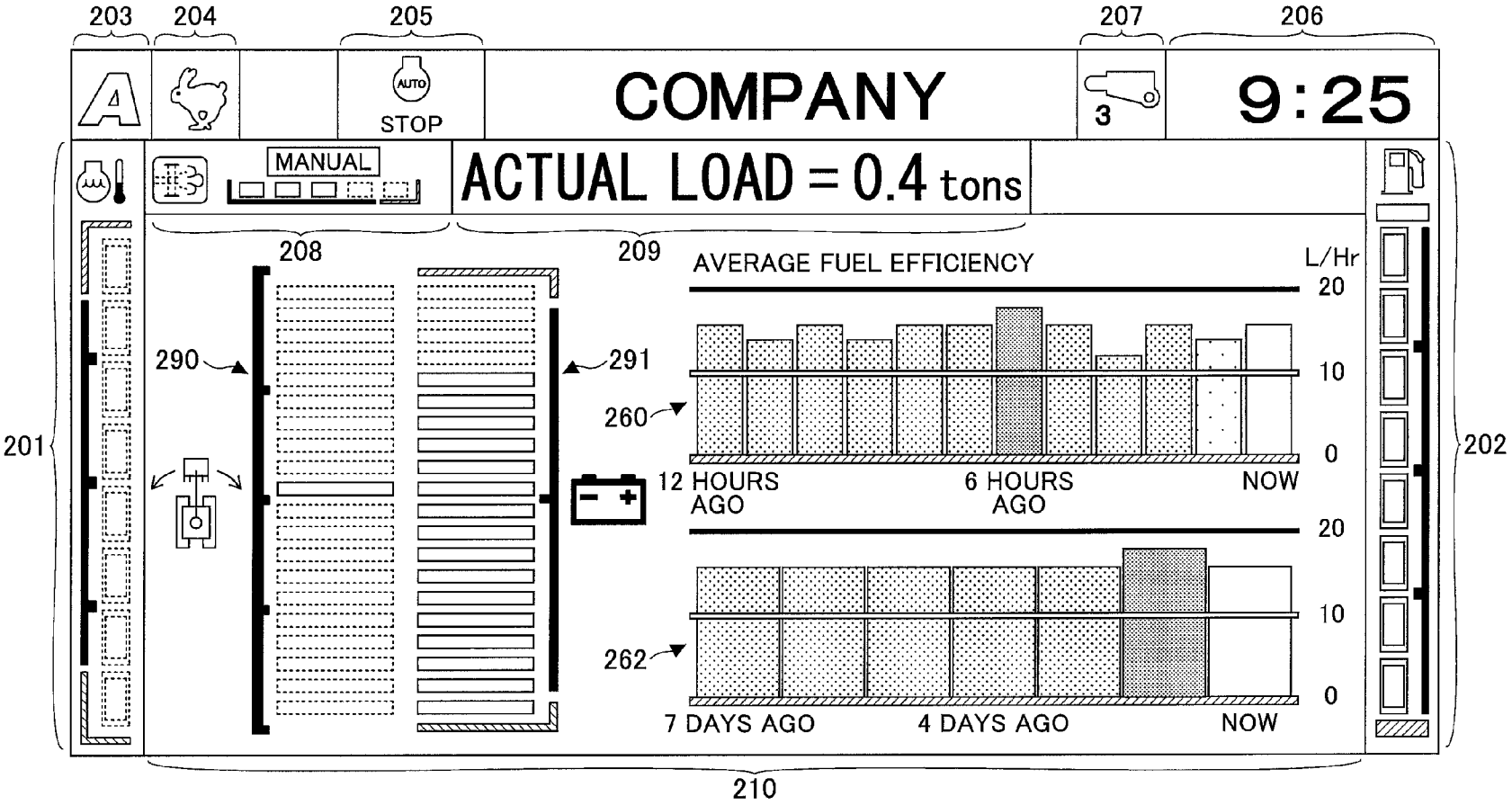
FIG. 9 is a diagram illustrating a screen of the display monitor on which a graph showing a physical quantity of a turning electric motor and a graph showing the state of charge of a capacitor are simultaneously displayed in addition to multiple graphs showing average fuel efficiency, to which information on a work mode is added, according to an embodiment.

FIG. 9 is a diagram illustrating a screen of the display monitor 42 on which a graph showing a physical quantity of the turning electric motor 21 is simultaneously displayed in addition to two graphs showing average fuel efficiency.

On a display screen 500 illustrated in FIG. 9, the bar graphs 260 and 262 of average fuel efficiency illustrated in FIG. 6, a graph 290 of the output of the turning electric motor 21, and a graph 291 of the state of charge of the capacitor 19 are simultaneously displayed.

The output of the turning electric motor 21 is determined based on the current value detected from the current sensor 20*a* of the inverter 20 or based on the current value and the voltage value detected from both the current sensor 20*a* and the voltage sensor 20*b* of the inverter 20. Furthermore, the state of charge of the capacitor 19 is determined based on the voltage value detected in the capacitor voltage detecting part 112.

The above-described graphical display of the output of the turning electric motor 21 allows the operator to instantaneously visually understand how much electric power is consumed or how much electric power is generated by a turning operation currently performed. This makes it possible for the operator to, for example, determine the appropriateness of the operator's turning operation in light of energy saving and to learn an appropriate turning lever operation in light of energy saving. Furthermore, graphically displaying the state of charge of the capacitor 19 makes it possible for the operator to check the state of charge of the capacitor 19 substantially simultaneously while checking basic information. Thus, the convenience of the display unit 80 is increased. Furthermore, there is no need to switch the display screen to check the state of charge of the capacitor 19, and it is possible to check the state of charge while operating an operation lever.

Furthermore, displaying the state of charge of the capacitor 19 beside the output display of the turning electric motor 21 on the same screen makes it possible for the operator to, for example, try to positively perform such a turning lever operation as to enable power generation when the state of charge is low. Furthermore, it is possible for the operator to see how the state of charge changes in the case of continuing the operator's turning operation while viewing a single display screen. Thus, the convenience of the display unit 80 is increased.

Thus, a simultaneous display of a graph showing average fuel efficiency, a graph showing the output of the electric turning motor 21, and a graph showing the state of charge of the capacitor 19 on a single screen makes it possible for the shovel operator to instantaneously obtain these information items without releasing her/his hand from an operation lever to perform an operation to switch a screen. Thus, the convenience of the display unit 80 is increased.

In the example display illustrated in FIG. 9, the bar graphs 260 and 262 may be replaced with the bar graphs 270 and 272 illustrated in FIG. 7 or the bar graphs 280 and 282 illustrated in FIG. 8.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A shovel, comprising:

a display monitor provided in a cabin of the shovel;

a main pump that generates a hydraulic pressure;

an internal combustion engine that drives the main pump;

a plurality of hydraulic actuators connected to the main pump via a valve;

a boom, an arm connected to the boom, and a bucket connected to the arm, the boom, the arm, and the bucket being driven by the plurality of hydraulic actuators; and a display control part, including a processor; and a memory storing a program that, when executed by the processor, causes the display control part to display a graph on a single display screen on the display monitor, based on information communicated between the display control part and the internal combustion engine, the graph simultaneously showing, with respect to each of a plurality of time periods of a predetermined time unit, which are equal in length and arranged along a time axis, a fuel efficiency of the internal combustion engine and an operational work mode of the shovel selected from a plurality of operational work modes of the shovel and set in said each of the plurality of time periods, wherein the plurality of operational work modes are assigned respective different display colors, and when first and second different operational work modes are selected from the plurality of operational work modes and set in one of the plurality of time periods, and switched within said one of the plurality of time periods, show the fuel efficiency in said one of the plurality of time periods in only one of the different display colors assigned to the first operational work mode, the first operational work mode being set for a longer time than the second operational work mode within said one of the plurality of time periods.

2. The shovel as claimed in claim 1, wherein the fuel efficiency and the first operational work mode are shown in a single bar with respect to each of the plurality of time periods.

3. The shovel as claimed in claim 1, wherein the fuel efficiency is one of fuel efficiency averaged based on a first predetermined time, fuel efficiency averaged based on a second predetermined time during which the internal combustion engine is in operation, and fuel efficiency averaged based on a third predetermined time during which a lever is operated.

4. The shovel as claimed in claim 1, wherein the plurality of operational work modes are determined by respective setting values of an output of the internal combustion engine, wherein a greater setting value among the setting values corresponds to a greater target value of a rotational speed of the internal combustion engine, and the setting values are selected and input through an input part provided in the cabin.

5. The shovel as claimed in claim 1, wherein the graph includes a first graph and a second graph that are arranged at vertically different positions, the plurality of time periods of the first graph are of a first time unit, and the plurality of time periods of the second graph are of a second time unit different from the first time unit, and in each of the first graph and the second graph, when the first and second operational work modes are selected from the plurality of operational work modes and set in said one of the plurality of time periods, and switched within said one of the plurality of time periods, the display control part is caused to show the fuel efficiency in said one of the plurality of time periods in said only one of the different display colors assigned to the first operational work mode within said one of the plurality of time periods.

6. The shovel as claimed in claim 2, wherein the single bar is variable in vertical length in the graph.

7. A shovel, comprising:

a display monitor provided in a cabin of the shovel;

a main pump that generates a hydraulic pressure;

an internal combustion engine that drives the main pump;

a plurality of hydraulic actuators connected to the main pump via a valve;

a boom, an arm connected to the boom, and a bucket connected to the arm, the boom, the arm, and the bucket being driven by the plurality of hydraulic actuators; and a display control part, including a processor; and a memory storing a program that, when executed by the processor, causes the display control part to display a time series of a fuel efficiency of the internal combustion engine in a plurality of bars on the display monitor, based on information communicated between the display control part and the internal combustion engine, the plurality of bars being successively arranged along a time axis that is divided into a plurality of time periods of a predetermined time unit, and each corresponding to one of the plurality of time periods, the plurality of time periods being equal in length, and the fuel efficiency being represented by a length of each of the plurality of bars in a direction perpendicular to the time axis, and display, on the display monitor, an operating condition of the shovel regarding the fuel efficiency of the internal combustion engine in each of the plurality of time periods by displaying each of the plurality of bars in a color corresponding to the operating condition of the shovel in said one of the plurality of time periods to which said each of the plurality of bars corresponds, wherein the operating condition to which the color corresponds is dominant relative to another operating condition within said each of the plurality of time periods.

8. The shovel as claimed in claim 7, wherein the display control part is further caused to display the time series in a first graph and a second graph that are arranged at vertically different positions, the plurality of time periods of the first graph are of a first time unit, and the plurality of time periods of the second graph are of a second time unit different from the first time unit, and the display control part is further caused to display, in each of the first graph and the second graph, each of the plurality of bars in the color corresponding to the operating condition of the shovel set in said one of the plurality of time periods to which said each of the plurality of bars corresponds.

9. The shovel as claimed in claim 7, wherein the operating condition of the shovel regarding the fuel efficiency of the internal combustion engine is an operational work mode of the shovel.

10. The shovel as claimed in claim 9, wherein the operational work mode is determined by a setting value of an output of the internal combustion engine, wherein the setting value corresponds to a target value of a rotational speed of the internal combustion engine, and the target value increases as the setting value increases, and the setting value is selected and input through an input part provided in the cabin.

11. The shovel as claimed in claim 9, wherein a plurality of colors for displaying the plurality of bars are stored in correspondence to a plurality of operational work modes of the shovel in the memory, and the display control part is further caused to calculate the fuel efficiency of the internal combustion engine based on the information communicated between the display control part and the internal combustion engine with respect to each of the plurality of time periods, assign the calculated fuel efficiency to each of the plurality of bars corresponding to said each of the plurality of time periods, and display each of the plurality of bars assigned with the calculated fuel efficiency in one of the plurality of colors corresponding to the operational work mode set in said each of the plurality of time periods.

12. The shovel as claimed in claim 7, wherein each of the plurality of bars is variable in the length in the direction perpendicular to the time axis.

* * * * *